US006044639A

United States Patent [19]

Weeger et al.

[11] Patent Number: 6,044,639

[45] Date of Patent: Apr. 4, 2000

[54] FLYER ASSEMBLY FOR ROVING FRAME

[75] Inventors: Hans-Peter Weeger, Hattenhofen; Jörg Hummel, Ebersbach; Hans-Jürgen Schönfelder, Waiblingen, all of Germany

[73] Assignees: Zinser Textilmaschinen GmbH, Ebersbach/Fils; Ernst Holz Textilmaschinenzubehor, Waiblingen, both of Germany

[21] Appl. No.: 09/076,929

[22] Filed: May 13, 1998

[30] Foreign Application Priority Data

Jun. 30, 1997 [DE] Germany ..... 197 27 799

[51] Int. Cl.[7] ..... D01H 1/04

[52] U.S. Cl. ..... 57/67; 67/116; 67/117; 67/267

[58] Field of Search ..... 57/67, 115, 117, 57/267, 276

[56] References Cited

U.S. PATENT DOCUMENTS

| | | | |
|---|---|---|---|
| 350,782 | 10/1886 | Smith | 57/117 |
| 3,380,238 | 9/1966 | Araki et al. | 57/67 |
| 4,361,005 | 11/1982 | Weeger et al. | 57/117 |
| 4,377,931 | 3/1983 | Novak et al. | 57/117 |
| 5,375,405 | 12/1994 | Weeger | 57/67 X |
| 5,657,623 | 8/1997 | Mack et al. | 57/67 |
| 5,697,205 | 12/1997 | Mack | 57/267 |

FOREIGN PATENT DOCUMENTS

| | | |
|---|---|---|
| 30 04 165 C2 | 12/1988 | Germany . |
| 195 43 716 | 6/1996 | Germany . |

*Primary Examiner*—William Stryjewski
*Attorney, Agent, or Firm*—Herbert Dubno

[57] ABSTRACT

An automatic spinning start-up flyer for a roving frame which has on a flyer arm a swingably-mounted pressing finger comprised of a pressing finger bar and a pressing finger arm with a pressing finger blade. The pressing finger assembly is mounted on a pivot axis at the centrum of the connection of the pressing finger with the flyer arm and is rotated about the bobbin center. The pressing finger rod lies outside the radius along which the pressing finger arm with pressing finger blade are arranged and the pressing finger bar is actuatable by an actuating element effective transverse to the pivot axis upon the pressing finger bar to swing the pressing finger into its outwardly-swung position. With the flyer, a wide opening of the pressing finger can be effected automatically for automatic bobbin change without a loading of the pressing finger against the sleeve or bobbin. This is achieved in that the flyer arm has at least one spring element whose spring force is effective on the pressing finger only in a pivot region thereof in which the center of gravity of the pressing finger lies outside the radius.

11 Claims, 6 Drawing Sheets

FLYER ASSEMBLY FOR ROVING FRAME

FIELD OF THE INVENTION

The present invention relates to a flyer for a roving frame which has a pressing finger swingably mounted with its pressing-finger rod and pressing-finger arm on one arm of the flyer, the pivot axis lying in the centrum of the connection of the pressing finger with the flyer arm. This flyer arm is rotatable about the center of the bobbin so that the pivot axis describes a predetermined radius R as the flyer arm orbits the bobbin. The pressing finger rod is acted upon by an actuating element transverse to the pivot axis to swing the pressing-finger arm into an outwardly swung position.

BACKGROUND OF THE INVENTION

With increasing automation in the roving field, new requirements are constantly having to be met as to the shape of the flyer to satisfy the needs of automating bobbin replacement.

Bobbin replacement can be effected by, for example, lowering of the bobbin rail together with the full bobbins which extend upwardly from the bobbin supports thereon, thereby displacing the full bobbins out of the region of the flyers. The full bobbins are then gripped at their free core sleeve ends and withdrawn from the machine by a bobbin pick-up system which is fed into the roving frame at the level of the bobbin rail.

In order to ensure that the pressing finger with its pressing-finger plate will rest against the core sleeve surface after insertion of the empty core sleeve, it is known from German patent 30 04 165 to provide a roving tube on the flyer arm carrying the pressing finger which defines a cylindrical space in which a cylindrical torsion spring is received which surrounds the roving tube and is connected at one end with the roving tube and at the other end with the flyer arm. This spring effects a pressing of the pressing finger against the core sleeve.

A disadvantage with this approach, however, is that the spring maintains a constant pressing force upon the sleeve and the roving wound thereon upon winding of the sleeve with the roving and this has an increasingly negative effect on bobbin formation with increasing bobbin diameter and can be detrimental to the material wound up. In addition, the shape of the pressing finger and the pressing-finger plate must satisfy special requirements and special deflecting skids and abutments must be provided in order to enable an automatic bobbin replacement.

German patent document 195 43 716 A1 describes flyers for roving frames which have pressing fingers comprised of pressing-finger rods or bars and pressing-finger arms carrying pressing-finger plates. The pressing-finger rod or bar which lies outside a pivot axis, can be swung by an actuating element effective transverse to the pivot axis so that the pressing finger can be pivoted into an outwardly swung position and can be held in this position. The pressing finger can be swung outwardly sufficiently that the full bobbin can be removed from the rotation region on the flyer. To enable the pressing finger to flip back for automatic incipient spinning, the abutment on the flyer arm must be so provided that the center of gravity of the respective abutment and pressing finger is so oriented that it will ensure an inward swing of the pressing finger against the bobbin upon the initiation of spinning. Reference may also be had to U.S. Pat. No. 5,657,623 with respect to the actuation elements which engage such pressing-finger bars.

With these known systems which provide for wide opening of the pressing finger, the pressing finger can remain in its outwardly swung position during incipient spinning. The reason for this is, above all, that the abutment on the flyer arm is configured as a rigid abutment. During the hard positioning of the pressing finger in the outwardly swung position, wear of contacting parts tends to be pronounced and, as a consequence there may be a change in the location of the outwardly swung position of the pressing finger during machine operation. Because of this wear, the center of gravity of the pressing finger may change with time and during start-up of the spinning process. The pressing finger may not automatically swing back against the core sleeve and the initial turns of the roving on the bobbin. The undeniable result is that because of the close spacing of the flyers (diagonal spacing of the flyer pitch), especially in the case of large bobbin sizes, the pressing fingers may engage in one another and thereby be damaged.

OBJECTS OF THE INVENTION

An object of the invention is to so improve a flyer of the aforedescribed type that wide opening of the pressing finger is enabled for bobbin change and the pressing finger can automatically be guided against the empty core sleeve for automatic spinning start-up without continuous loading the pressing finger by a pressing force against the sleeve or bobbin.

Another object of the invention is to provide a flyer for a roving frame which is free from the drawbacks previously mentioned and which, in a particularly effective manner, allows wide swinging of the pressing finger for bobbin replacement operations, but yet avoids any detrimental effect that spring bias of the finger may have during the winding of the bobbin.

Still another object of the invention is to provide an improved spinning flyer which can increase the efficiency of operation of a roving frame.

SUMMARY OF THE INVENTION

This object is attained in accordance with the invention in that the flyer arm has at least one spring element whose spring force acts upon the pressing finger only in that portion of the pivot range in which the center of gravity of the pressing finger lies within the radius R. The pivot axis lies in the centrum of the connection of the pressing finger with the flyer arm and is rotatable about the center of the bobbin with the radius R.

When, for start-up of spinning, the flyer together with this pivot axis is set in rotation, the center of gravity of the pressing finger must lie outside this radius R so that an inward swing of the pressing finger plate will be effected against the bobbin sleeve.

The center of gravity of the pressing finger lies in the pressing-finger rod or bar whose weight is greater than that of the pressing-finger arm. Upon the rotary movement of the flyer, the pressing-finger rod which contains the center of gravity is pressed outwardly by the centrifugal force and thus the pressing-finger arm is pressed against the bobbin sleeve.

When the center of gravity of the pressing finger upon start-up lies within the pivot axis-bobbin center radius, the pressing-finger arm is not swung against the bobbin sleeve but rather is swung outwardly. Until the position in which the center of gravity of the pressing finger moves outwardly of the radius (R), the pressing finger is not spring-loaded and thus swings about its pivot axis exclusively based upon the center of gravity upon rotation of the flyer by itself into its spinning start-up position.

To enable the pressing finger however to open for a swing-out which is sufficiently wide that the center of gravity of the pressing finger will lie within the radius (R) and permit the full bobbin removal from the flyer upon bobbin replacement without problems, the pressing finger must be moved against the spring force of the spring element arranged on the flyer. After the actuating element which is effective for opening on the pressing finger rod, frees the pressing finger, the pressing element acts to spring the pressing finger or rotate the pressing finger back into its position wherein the center of gravity of the pressing finger again lies outside the radius (R). Apart from this, it is especially advantageous that the flyer in accordance with the invention does not apply the pressing finger pressure with a continuous increase during the spinning process to the bobbin.

The spring element against which the pressing finger moves prevents the pressing finger from impacting against a rigid stop on the flyer arm and can thereby cause damage to the flyer arm and/or the pressing finger. With the flyer according to the invention, the requisite position of the pressing finger for automatic start-up of spinning and the requisite position of the pressing finger for removal of full bobbins can be ensured.

Advantageously, the spring element is a component of the fastening means which is arranged to fix the pressing finger on the flyer arm and is located between the pressing finger and the flyer arm. Upon damage to the spring element, the defective part can be easily and immediately replaced. It is, however, also possible to apply the spring element directly on the flyer arm.

According to a further feature of the invention, the spring element is a retaining rod which via fastening eyes of the flyer arm and the pressing finger, acts as a common guide for them. The retaining rod is secured at its lower end against rotation on the flyer arm and opens with its upper end in a clamping piece which rests on the upper fastening eye of the flyer arm and is clamped into the latter. The clamping piece here serves as an abutment for the pressing finger rod in the outwardly swung position, whereby the center of gravity of the pressing finger still lies outside the radius R. With this arrangement of the clamping piece, there is no contact between the pressing finger rod and the flyer arm. For further opening of the pressing finger and thus the shifting of the center of gravity of the pressing finger inside the radius R, there is an engagement of the pressing finger via the actuating element and thus by exertion of the pressure of the pressing finger rod on the clamping piece, a rotation of the clamping piece with torquing of the retaining rod. As soon as the pressing finger rod is liberated from the actuating element, the retaining rod is torqued and the clamping piece is rotated therewith into its respective start position.

According to an advantageous feature of the invention, the extent of rotation of the clamping piece and thus the spring effect of the retaining rod can be adjusted by adjustment of the distance between the clamping piece resting upon the fastening eye and an abutment of the flyer arm, the pivoting stroke of the pressing finger from its outermost open position into the position where it is not loaded by the spring can thereby be influenced. A further possibility for generating the spring effect of the retaining rod is to hold the clamping piece fixed without providing a spacing from the abutment on the flyer arm and, on the other hand, to fasten the retaining rod rotatably on the lower fastening eye of the flyer arm.

The retaining rod in this embodiment has at its lower end, a fastening lug which serves simultaneously as an abutment for the pressing finger in the position in which the center of gravity of the pressing finger is still outside the radius R. If the pressing finger is further opened from this position, the pressing finger bears against the fastening lug and rotates the latter, thereby applying torque to the retaining rod. Depending upon the kind of arrangement or the position of the fastening lug of the retaining rod in its rest position, the spring-loaded pivotal stroke of the pressing finger can be influenced.

According to a further feature of the invention, an abutment piece can rest on the upper fastening eye of the flyer arm. This abutment piece can then serve on the one hand as a receiver for a fastening means passing through the upper fastening eye of the flyer arm and the pressing finger, and can on the other hand have the spring element. The spring element is actuatable by the pressing-finger rod or bar against its spring force when the pressing finger is swung into the region in which the center of gravity of the pressing finger lies within the radius R.

If the pressing finger is liberated by the actuating element which is engageable therewith, the spring force of the spring element is effective to swing back the pressing finger into the region in which the center of gravity of the pressing finger lies outside the radius R so that the pressing finger is in its initial spinning position for start-up of the spinning operation.

The abutment part can, like the clamping piece already described, be clamped to the retaining rod and additionally can have the spring element. In this case, the clamping piece abuts the flyer arm without a spacing and the lower part of the retaining rod can also rest against the lower fastening eye of the flyer arm without freedom of rotation relative thereto.

Alternatively, for fixing the pressing finger on the flyer arm, above and below a respective fastening eye, the separate fastening means can be used which are independent from one another. The abutment part which rests on the upper fastening eye of the flyer arm can be formed, for example, as a threaded part into which a screw traversing the upper fastening eye can be threaded and which is recessed in the spring element.

The spring element can advantageously be a spring-loaded ball in a sleeve which is biased by the spring force in the sleeve and can be pressed back, by relief of the pressing finger rod to enable the pressing finger to swing back to the position for spinning start-up by itself. The spring element can also be a leaf spring affixed to the abutment part, a disk-type spring or the like.

According to another aspect of the invention at least one spring element on the flyer arm has a spring force which is only effective upon the pressing finger in a swinging region of the latter in which the pressing-finger plate or blade lies outside the maximum bobbin circumference. The spring force of the spring element becomes effective upon the pressing finger only when the pressing-finger plate or blade is swung or raised from the maximum wound bobbin position. In the operating state of the roving frame in which the bobbin winding terminates at the maximum bobbin circumference and the automatic bobbin replacement can begin, the pressing finger plates lie against the bobbin surfaces without spring loading. To enable the bobbin to be removed from the rotation regions of the flyer, the pressing fingers must be moved into positions appropriate for bobbin removal.

The pressing-finger rods or bars are engaged by actuating elements and swung about their pivot axes against the spring force of the spring element so that the pressing-finger plates or blades resting against the bobbins are swung away from the bobbin peripheries or surfaces. When the pressing-finger bars are liberated by the actuating elements, the spring force of the spring elements returns the pressing fingers into the position in which the pressing-finger plates or blades are located at the maximum bobbin circumference. In this case, the pressing fingers have their pressing-finger rods so located that the center of gravities are positioned, with rotation of the flyers to swing the pressing finger against the bobbin core sleeves which have replaced the full bobbins upon start-up of spinning. Simultaneously the flyers of the invention ensure that the bobbin can be wound during the winding process without additional detrimental pressing-finger pressure.

More specifically, the flyer for a roving frame according to the invention will comprise at least one flyer arm extending alongside a bobbin to be wound on the flyer frame and means for rotating the flyer to orbit the flyer arm about a bobbin axis;

a pressing finger pivotally mounted on the flyer arm so as to pivot about a pivot axis on the flyer arm located at a centrum of the pressing finger located at a radius R from the bobbin axis upon orbiting of the flyer arm, the pressing finger comprising:

a pressing-finger bar extending along the flyer arm and pivotally connected thereto, a pressing-finger arm rigidly connected to the pressing-finger bar, extending transversely thereto and swingable toward and away from the bobbin upon pivoting of the pressing-finger bar about the pivot axis on the flyer arm, and a pressing-finger blade on an end of the pressing-finger arm for guiding a roving onto the bobbin, the pressing-finger bar being engageable by an actuating element for swinging the arm into an outwardly swung position, the pressing finger having a center of gravity shiftable from within the radius R to outside the radius R upon swinging about the pivot axis; and at least one spring having a spring force acting upon the pressing finger only while the center of gravity is within the radius R.

In another aspect of the invention the flyer comprises:

at least one flyer arm extending alongside a bobbin to be wound on the flyer frame to a maximum bobbin circumference, and means for rotating the flyer to orbit the flyer arm about a bobbin axis;

a pressing finger pivotally mounted on the flyer arm so as to pivot about a pivot axis on the flyer arm located at a centrum of the pressing finger located at a radius R from the bobbin axis upon orbiting of the flyer arm, the pressing finger comprising:

a pressing-finger bar extending along the flyer arm and pivotally connected thereto, a pressing-finger arm rigidly connected to the pressing-finger bar, extending transversely thereto and swingable toward and away from the bobbin upon pivoting of the pressing-finger bar about the pivot axis on the flyer arm, and a pressing-finger blade on an end of the pressing-finger arm for guiding a roving onto the bobbin, the pressing-finger bar being engageable by an actuating element for swinging the arm into an outwardly swung position; and at least one spring having a spring force acting upon the pressing finger only in a pivotal region of the pressing finger in which the pressing-finger blade is outside the circumference.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
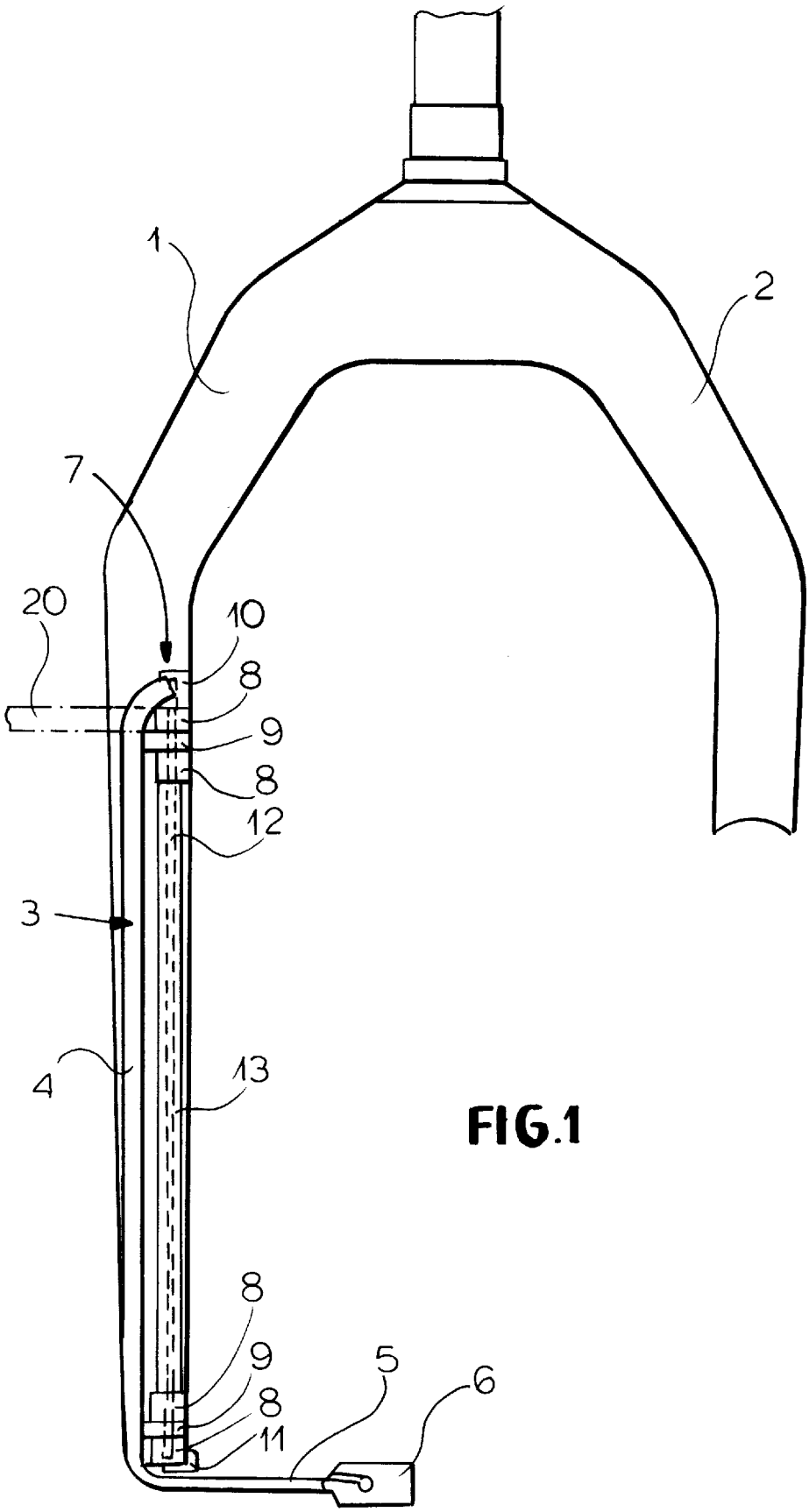
FIG. 1 is a schematic elevational view of a flyer with a pressing finger bar and pressing finger arm and a pressing finger plate on the pressing finger arm.

FIG. 1 schematically shows a spinning flyer for a roving frame, the flyer comprising a roving-guiding flyer arm 1 and a counterweight flyer arm 2.

On the flyer arm 1 is a pressing finger 3 comprised of a pressing-finger bar 4, a pressing-finger arm 5 rigid with the bar 4, and a pressing-finger plate or blade 6. The pivot axis 7 of the pressing finger 3 lies at the centrum of the connection of the pressing finger 3 with the flyer arm 1 and is rotatable about the center or axis 16 (FIG. 4) of the bobbin with a predetermined radius R, whereby the pressing-finger bar 4 lies outside the pivot axis 7. The maximum bobbin circumference is shown at C in FIG. 4.

Pressing finger 3 and flyer arm 1 each have fastening eyes 8 and 9 which are traversed by a retaining rod 12 for connecting the pressing finger 3 and the flyer arm 1. The retaining rod 12 has at its one end a fastening lug 11 with which the retaining rod 12 is held against rotation on the lower fastening eye 8 of the flyer arm 1. The other end of the retaining rod 12 opens in a clamping piece 10 lying on the upper fastening eye 8 of the flyer arm 1 and is clamped or tightened securely in the latter.

To form the connection between the flyer arm 1 and the pressing finger 3, the retaining rod 12 is passed first through the lower fastening eye 8, 9, then through a sleeve 13, for example of plastic, and then through the upper fastening eyes 8 and 9. The retaining rod 12 is fixed with its fastening lug 12 on the desired location of the lower fastening eye 8. The clamping piece 10 is fitted onto the upper end of the retaining rod 12 and is clamped by means of set screws (not shown) in the clamping piece 10.

Figure 3:
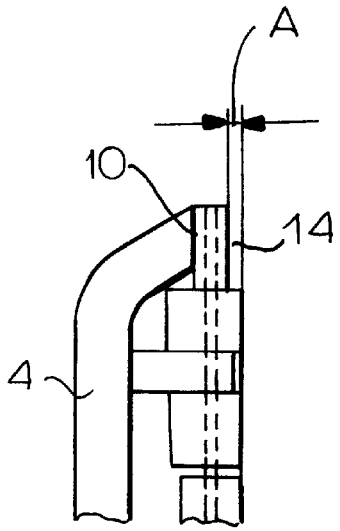
FIG. 3 is a detail of the region III of FIG. 2.
Figure 2:
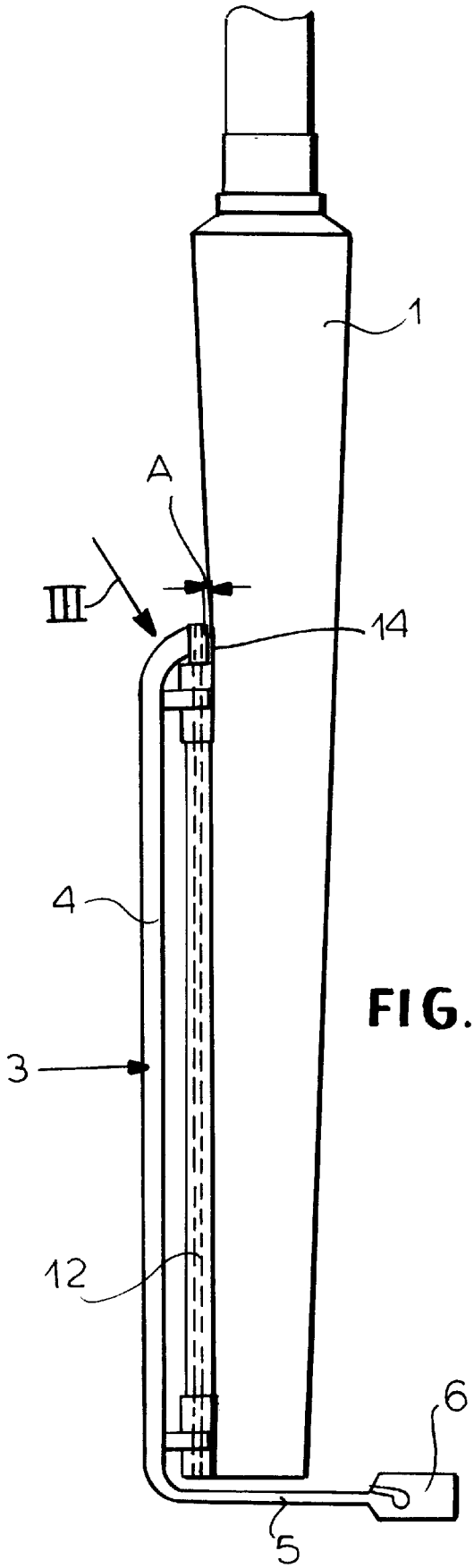
FIG. 2 is a schematic side elevational view of the flyer arm 1 according to FIG. 1.

As can also be seen from FIGS. 2 and 3, the pressing finger bar 4 functions with a counterweight for the curved pressing-finger arm 5 with its pressing finger plate or blade 6. The upper end of the pressing-finger bar 4 has a curvature toward the clamping piece 10.

When the pressing finger is rotated by an actuating element 20 acting upon the pressing-finger bar 4, the upper curved end of the pressing-finger bar 4, the upper curved end of the pressing-finger bar 4 impacts upon the clamping piece 10 which is located at a distance A from an abutment 14 on the flyer arm. In this position of the pressing finger, the center of gravity of the pressing finger is still outside the radius R.

The actuating element can have any of the actuating-element configurations of U.S. Pat. No. 5,657,623. The "at least one spring" whose spring force acts upon the pressing finger only while the center of gravity is within the radius R is here the torsion bar formed by the rod 4 when its curved upper end engages a stop or abutment as described.

An alternative to the curvature at the upper end of the pressing finger bar can be an arrangement in which the pressing finger bar 4 has an abutment projecting therefrom, for example, welded to the pressing finger bar which abuts the clamping piece 10 or is pressed against the latter when the pressing finger 3 is rotated.

Figure 4:
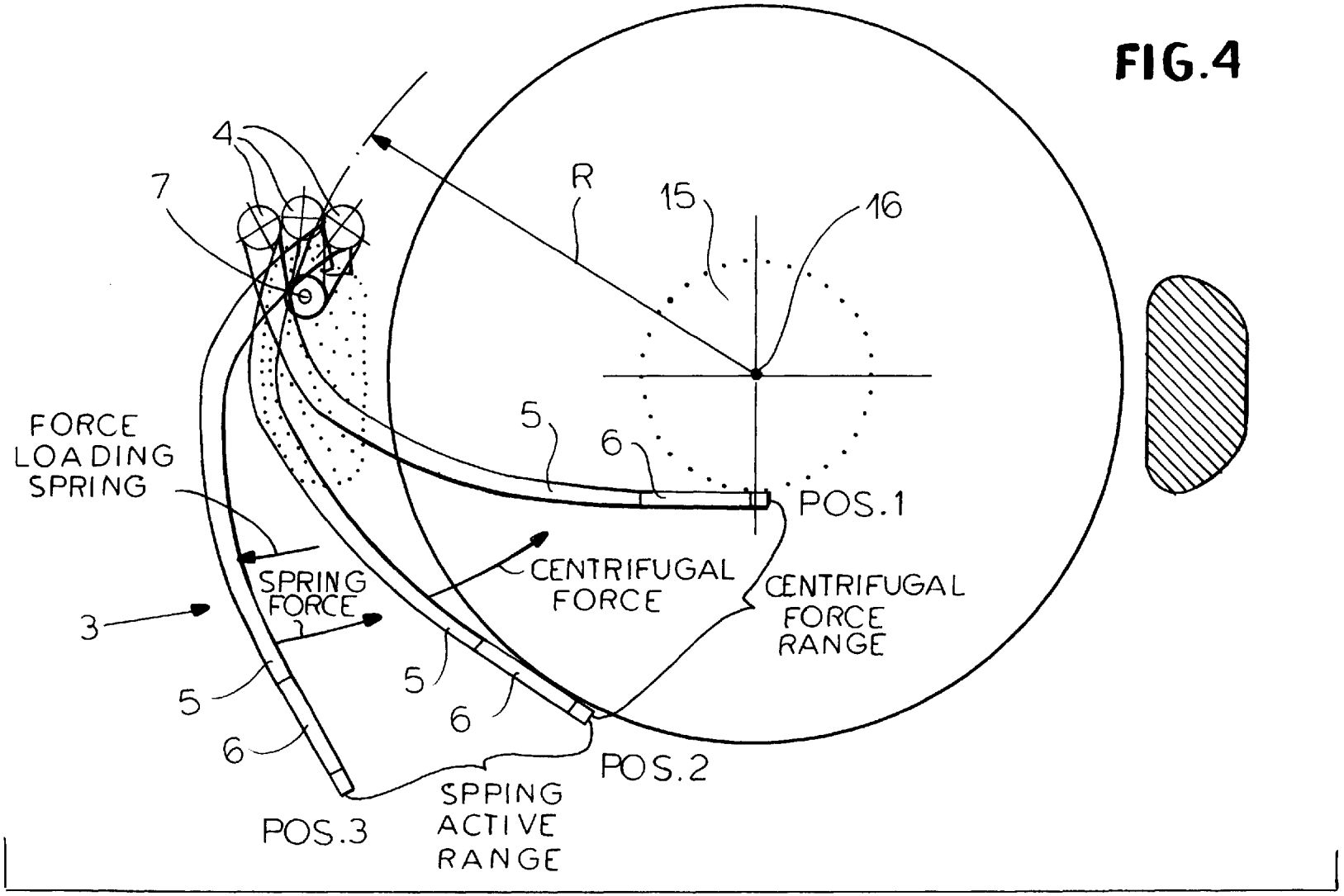
FIG. 4 is a schematic bottom view of the flyer, partly broken away.

In FIG. 4, three different pressing finger positions have been illustrated as arise during machine operation. Position 1 indicates the position on start-up of spinning, in which the pressing finger 3 is swung inwardly so that the pressing-finger plate 6 rests against the empty core sleeve 15. With increasing winding of the bobbin, the pressing finger 3 together with the pressing finger arm 5 and the pressing-finger plate 6 are moved outwardly and can be found, upon complete bobbin winding, at the maximum bobbin periphery represented as position 2. In this position, the pressing-finger plate 6 rests on the outer surface of the bobbin while the center of gravity of the pressing finger 3 nevertheless lies outside the radius R.

The pressing finger 3 is not pressed by any additional spring element against the bobbin since this would negatively influence the quality of the wound roving. In order to permit the bobbin to be removed from the rotation region of the flyer in an embodiment, for example, where the bobbin suspended from a central pin of the flyer, the pressing finger 3 must be swung away sufficiently that the pressing finger arm 5 is displaced at least between position 2 and position 3, but preferably is in position 3, i.e. the outermost edge of the pressing-finger plate 6 lies outside the maximum bobbin periphery or lies on a line with the inside of the flyer arm 1.

If the pressing-finger bar 4 is engaged by an actuator 20, the pressing finger arm 5 is moved into the position 3. Between the position 2 and position 3, the pressing finger 3 rests with its upper curvature initially on the clamping piece 10 (FIG. 2). At this moment, the center of gravity of the pressing finger 3 still lies outside the radius R. To permit it to pass into the position 3, the end of the pressing finger bar 4 lying on the clamping piece 10 (FIG. 2) presses against the clamping piece 10 and rotates the latter through the distance A while applying torque to the retaining rod 12 (FIG. 2). First in this position 3, is the center of gravity of the pressing finger 3 located within the radius R. Only in the pivot position in which the center of gravity of the pressing finger 3 is found within the radius R or the pressing finger plate 6 lies outside the maximum bobbin periphery, does the spring force, which results from the torsion of the retaining rod act upon the pressing finger 3. When the pressing finger 3 is relieved from the action of the actuating element 20, the pressing finger 3 is pressed by the reverse rotation of the clamping piece 10 by the retaining rod 12 back into the position 2 and thus finds itself in a position in which the pressing finger, in automatic start-up of spinning, is applied by its centrifugal force automatically in the spinning start-up position upon setting of the flyer into rotation.

Figure 5:
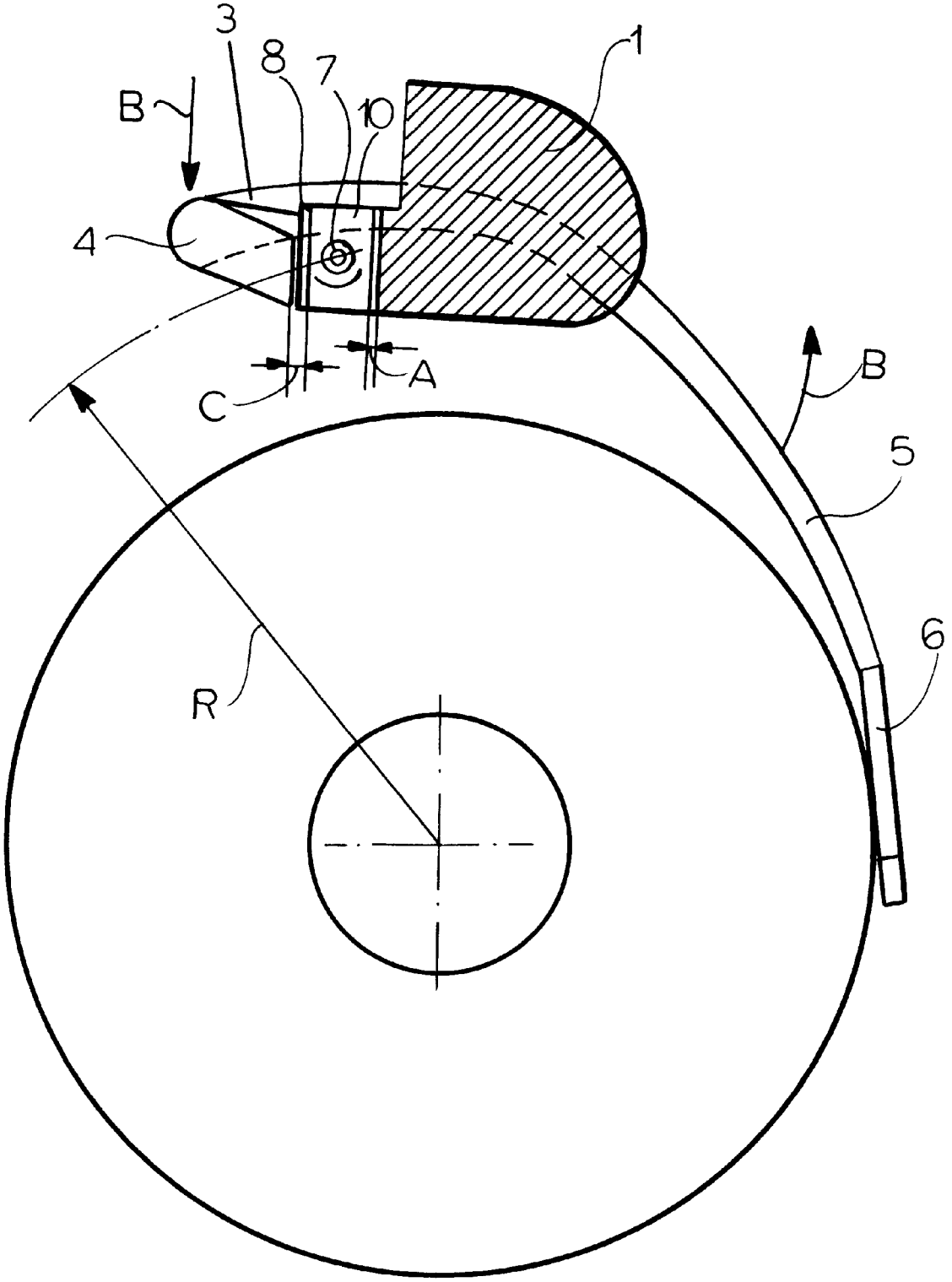
FIG. 5 is a flyer arm with a pressing finger shown in section above the clamping piece.

In FIG. 5, the previously described position 2 has been illustrated. The flyer arm 1 is cut away above the clamping piece 10. From this schematic illustration it is apparent that the upper end of the pressing-finger bar 4 has a spacing C from the clamping piece 10 which rests upon the upper fastening eye of the flyer arm 1. If the pressing finger 3 is actuated in the direction of the arrow B, the pressing finger 3 swings about the axis 7 and the curved end of the pressing-finger bar 4 is moved toward the clamping piece 10 until the end of the pressing-finger bar 4 comes to rest upon the clamping piece 10. With further opening of the pressing finger 3, the end of the pressing finger bar 4 then presses against the clamping piece 10 so that it rotates the retaining rod 10 so as to apply torsion thereto. The distance A thus determines the rotary stroke of the clamping piece 10 and the inward swing path of the spring loading of the pressing finger 3.

Figure 6:
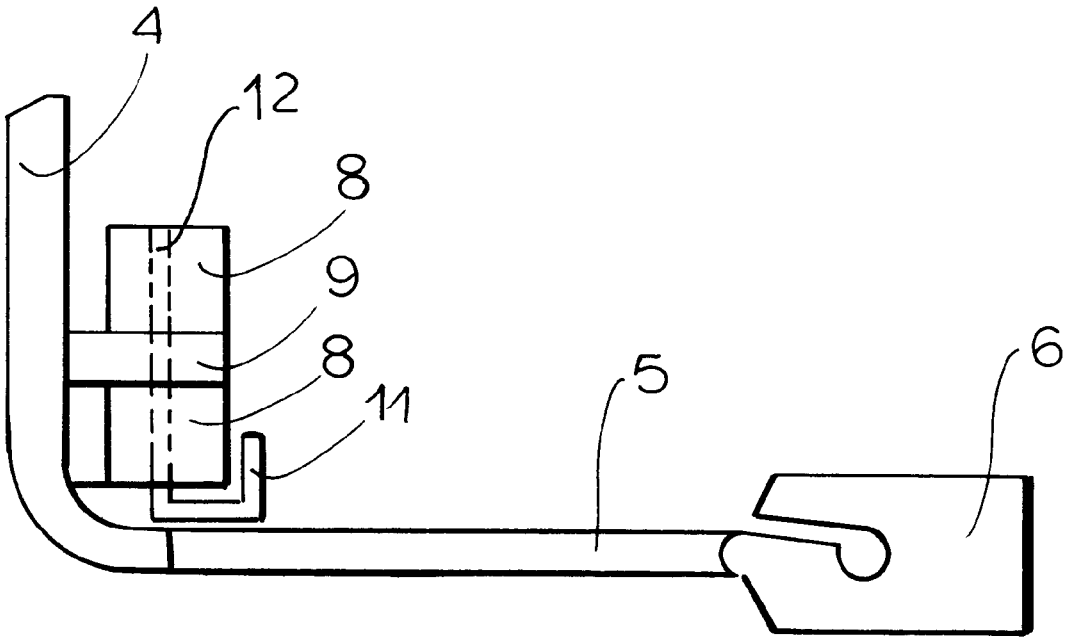
FIG. 6 is a detail view of the fastening of the retaining rod on the lower fastening eye.

FIG. 6 shows the mounting of the retaining rod 12 drawn to a larger scale. The lower end of the retaining rod 12 has a U-shaped bent fastening lug 11 which has been shoved onto the lower fastening eye 8 and is held by the retaining rod 12 in a nonrotatable manner. In the embodiment illustrated in which the clamping piece 10 lies against the abutment of the flyer arm 1 without a distance A between them, the fastening lug is so arranged that by swinging of the pressing finger 3 of the pressing finger arm 5, the fastening lug 11 is engaged (position 2), and as soon as the pressing finger 3 is rotated in a region (position 3) in which the center of gravity of the pressing finger lies within the radius R or the pressing finger blade 6 lies outside the maximum bobbin periphery, the fastening lug 11 rotates to torsion the retaining rod 12.

Figure 8:
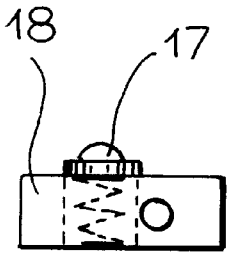
FIG. 8 is a sectional view along line VIII—VIII of FIG. 7.
Figure 7:
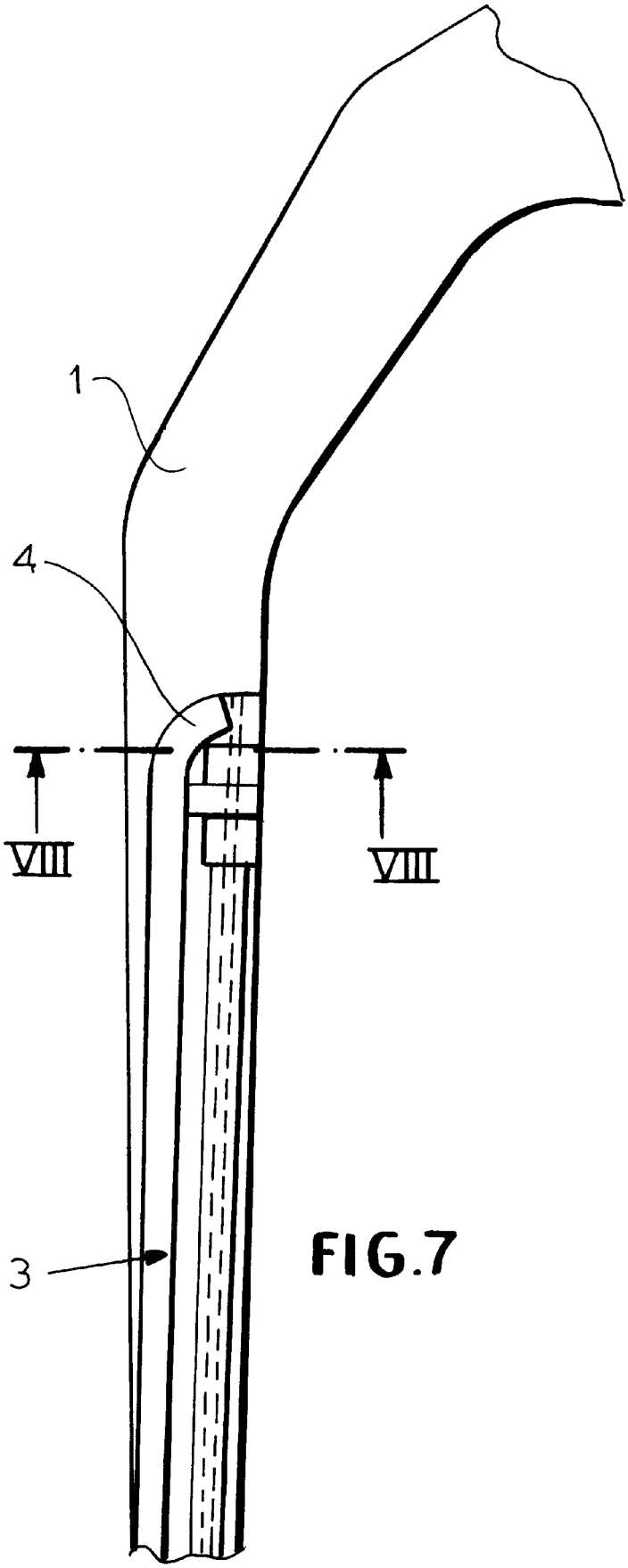
FIG. 7 is a clamping piece with an integrated spring element.

Another embodiment of the abutment part 18 or the clamping piece has been shown in FIGS. 7 and 8. In this embodiment the abutment part 18 has a spring element 17 and is arranged without a spacing A on the upper fastening eye of the flyer arm 1. Until engagement of the upper end of the pressing finger arm 4 against the spring element 17, the center of gravity of the pressing finger 3 lies outside the radius R. Only when the pressing finger 3 is pressed against the spring force of the spring element 17 and is pressed against the spring element 17 does the center of gravity of the pressing finger 3 locate itself within the radius R. The spring element 17 in FIG. 8 is a ball, spring-loaded in a bushing, and can be pressed against its spring force into the bushing. When the pressing finger 3 is liberated from the actuating element, the spring finger 3 is pressed back by the compressed spring acting upon the ball into the position in which the center of gravity of the pressing finger 3 again lies externally of the radius R.

We claim:

1. A flyer for a roving frame, comprising:

at least one flyer arm extending alongside a bobbin to be wound on the flyer frame to a maximum bobbin circumference, and means for rotating the flyer to orbit the flyer arm about a bobbin axis;

a pressing finger pivotally mounted on said flyer arm so as to pivot about a pivot axis on said flyer arm located at a centrum of said pressing finger located at a radius R from said bobbin axis upon orbiting of said flyer arm, said pressing finger comprising:

a pressing-finger bar extending along said flyer arm and pivotally connected thereto, a pressing-finger arm rigidly connected to said pressing-finger bar, extending transversely thereto and swingable toward and away from said bobbin upon pivoting of said pressing-finger bar about said pivot axis on said flyer arm, and a pressing-finger blade on an end of said pressing-finger arm for guiding a roving onto said bobbin, said pressing-finger bar being engageable by an actuating element for swinging said arm into an outwardly swung position; and at least one spring having a spring force acting selectively upon said pressing finger only in a pivotal region of said pressing finger in which said pressing-finger blade is outside said circumference.

2. The flyer defined in claim 1 wherein said spring is a component of fastening means which are arranged to fix said pressing finger on the flyer arm between said pressing finger and said flyer arm.

3. The flyer defined in claim 1 wherein said spring includes a retaining rod which is guided through fastening eyes of the flyer arm and the pressing finger together, whereby the retaining rod at a lower end is fastened so as to be nonrotatably engaged with the flyer arm and at an upper end is fastened in a clamping piece which rests on the upper fastening eye of the flyer arm whereby the clamping piece simultaneously is an abutment for the pressing finger rod in an outwardly swung position of the pressing finger in which the center of gravity of the pressing finger continues to lie outside the radius R.

4. The flyer defined in claim 3 wherein said clamping piece upon pressing of the pressing finger on the clamping piece when the center of gravity of the pressing finger lies outside the radius R, is rotatable by torque of the retaining rod.

5. The flyer defined in claim 3 wherein a distance between the fastening eye and the clamping piece is adjustable to adjust the rotation of the clamping piece and a spring effect of the retaining rod are adjustable.

6. The flyer defined in claim 1 wherein an abutment piece rests on an upper fastening eye of the flyer arm and has a receiver for an actuating means guided through upper fastening eyes in common of the flyer arm and the pressing finger and a spring element is provided on the abutment piece to actuate the pressing finger against a spring force when the pressing finger is swung out of the region in which the center of gravity of the pressing finger lies outside the radius R.

7. The flyer defined in claim 6 wherein the spring element has a spring-loaded ball in a sleeve and which can be pressed into the sleeve against the spring force.

8. A flyer for a roving frame, comprising:

at least one flyer arm extending alongside a bobbin to be wound on the flyer frame and means for rotating the flyer to orbit the flyer arm about a bobbin axis;

a pressing finger pivotally mounted on said flyer arm so as to pivot about a pivot axis on said flyer arm located at a centrum of said pressing finger located at a radius R from said bobbin axis upon orbitting of said flyer arm, said pressing finger comprising:

a pressing-finger bar extending along said flyer arm and pivotally connected thereto, a pressing-finger arm rigidly connected to said pressing-finger bar, extending transversely thereto and swingable toward and away from said bobbin upon pivoting of said pressing-finger bar about said pivot axis on said flyer arm, and a pressing-finger blade on an end of said pressing-finger arm for guiding a roving onto said bobbin, said pressing-finger bar being engageable by an actuating element for swinging said arm into an outwardly swung position, said pressing finger having a center of gravity shiftable from within said radius R to outside said radius R upon swinging about said pivot axis; and at least one spring having a spring force acting upon said pressing finger only while said center of gravity is within said radius R, said spring includes a retaining rod which is guided through fastening eyes of the flyer arm and the pressing finger together, whereby the retaining rod at a lower end is fastened so as to be nonrotatably engaged with the flyer arm and at an upper end is fastened in a clamping piece which rests on the upper fastening eye of the flyer arm whereby the clamping piece simultaneously is an abutment for the pressing finger rod in an outwardly swung position of the pressing finger in which the center of gravity of the pressing finger continues to lie outside the radius R.

9. The flyer defined in claim 8 wherein said clamping piece upon pressing of the pressing finger on the clamping piece when the center of gravity of the pressing finger lies outside the radius R, is rotatable by torque of the retaining rod.

10. A flyer for a roving frame, comprising:

at least one flyer arm extending alongside a bobbin to be wound on the flyer frame and means for rotating the flyer to orbit the flyer arm about a bobbin axis;

a pressing finger pivotally mounted on said flyer arm so as to pivot about a pivot axis on said flyer arm located at a centrum of said pressing finger located at a radius R from said bobbin axis upon orbitting of said flyer arm, said pressing finger comprising:

a pressing-finger bar extending along said flyer arm and pivotally connected thereto, a pressing-finger arm rigidly connected to said pressing-finger bar, extending transversely thereto and swingable toward and away from said bobbin upon pivoting of said pressing-finger bar about said pivot axis on said flyer arm, and a pressing-finger blade on an end of said pressing-finger arm for guiding a roving onto said bobbin, said pressing-finger bar being engageable by an actuating element for swinging said arm into an outwardly swung position, said pressing finger having a center of gravity shiftable from within said radius R to outside said radius R upon swinging about said pivot axis; and at least one spring having a spring force acting upon said pressing finger only while said center of gravity is within said radius R, an abutment piece resting on an upper fastening eye of the flyer arm and having a receiver for an actuating means guided through upper fastening eyes in common of the flyer arm and the pressing finger and a spring element provided on the abutment piece to actuate the pressing finger against a spring force when the pressing finger is swung out of the region in which the center of gravity of the pressing finger lies outside the radius R.

11. The flyer defined in claim 10 wherein the spring element has a spring-loaded ball in a sleeve and which can be pressed into the sleeve against the spring force.

* * * * *